US009666328B2

(12) United States Patent
Metzger et al.

(10) Patent No.: US 9,666,328 B2
(45) Date of Patent: May 30, 2017

(54) ESTERS AS COOLING AND INSULATING FLUIDS FOR TRANSFORMERS

(71) Applicant: Fuchs Petrolub SE, Mannheim (DE)

(72) Inventors: Jürgen O. Metzger, Oldenburg (DE); Rolf Luther, Speyer (DE); Angela Robben, Mannheim (DE); Gunther Kraft, Weinheim (DE)

(73) Assignee: Fuchs Petrolub SE, Mannheim (DE)

( * ) Notice: Subject to any disclaimer, the term of this patent is extended or adjusted under 35 U.S.C. 154(b) by 0 days.

(21) Appl. No.: 14/396,829

(22) PCT Filed: Apr. 26, 2013

(86) PCT No.: PCT/DE2013/000222
§ 371 (c)(1),
(2) Date: Oct. 24, 2014

(87) PCT Pub. No.: WO2013/159761
PCT Pub. Date: Oct. 31, 2013

(65) Prior Publication Data

US 2015/0090944 A1 Apr. 2, 2015

(30) Foreign Application Priority Data

Apr. 26, 2012 (DE) ..... 10 2012 103 701

(51) Int. Cl.
*H01B 3/20* (2006.01)
*C10M 105/38* (2006.01)

(52) U.S. Cl.
CPC ..... *H01B 3/20* (2013.01); *C10M 105/38* (2013.01); *C10M 2207/024* (2013.01); *C10M 2207/026* (2013.01); *C10M 2207/282* (2013.01); *C10M 2207/2835* (2013.01); *C10M 2209/062* (2013.01); *C10M 2209/084* (2013.01); *C10M 2209/103* (2013.01); *C10M 2215/042* (2013.01); *C10M 2215/06* (2013.01); *C10M 2215/082* (2013.01); *C10M 2215/14* (2013.01); *C10M 2215/223* (2013.01); *C10M 2219/10* (2013.01); *C10N 2230/02* (2013.01); *C10N 2230/08* (2013.01); *C10N 2230/64* (2013.01); *C10N 2240/201* (2013.01)

(58) Field of Classification Search
CPC ..... H01B 3/20
USPC ..... 252/579
See application file for complete search history.

(56) References Cited

U.S. PATENT DOCUMENTS

| | | | | | |
|---|---|---|---|---|---|
| 5,376,294 | A * | 12/1994 | Okada | C08J 3/09 | 252/572 |
| 5,558,803 | A * | 9/1996 | Okada | C08J 3/09 | 252/572 |
| 6,037,537 | A * | 3/2000 | McShane | C09K 5/10 | 174/17 LF |
| 6,340,658 | B1 * | 1/2002 | Cannon | C10M 101/04 | 174/17 LF |
| 2002/0193259 | A1 * | 12/2002 | Bunemann | C10M 105/38 | 508/459 |
| 2003/0164479 | A1 * | 9/2003 | Goedde | H01F 27/12 | 252/570 |
| 2008/0033201 | A1 * | 2/2008 | Hof | C10M 105/38 | 560/201 |
| 2009/0121200 | A1 * | 5/2009 | Bates | C08G 65/34 | 252/579 |
| 2009/0140830 | A1 * | 6/2009 | Amanullah | H01B 3/22 | 336/94 |
| 2010/0048931 | A1 * | 2/2010 | Westfechtel | C07C 69/58 | 554/223 |
| 2010/0097167 | A1 | 4/2010 | Corkran et al. | | |
| 2010/0218953 | A1 * | 9/2010 | Leleux | C04B 26/16 | 166/302 |
| 2015/0090944 | A1 * | 4/2015 | Metzger | C10M 105/38 | 252/579 |

FOREIGN PATENT DOCUMENTS

| | | | | |
|---|---|---|---|---|
| DE | 102004025939 | A1 | 12/2005 | |
| DE | 102012103701 | A1 | 10/2013 | |
| EP | 0292025 | A2 | 1/1988 | |
| EP | 1958931 | A1 | 8/2008 | |
| GB | 1602092 | A * | 11/1981 | C10M 105/32 |
| JP | EP 0292025 | A2 * | 11/1988 | H01B 3/008 |
| WO | 9722977 | A1 | 6/1997 | |
| WO | 2004108871 | A1 | 12/2004 | |
| WO | 2005118756 | A1 | 5/2005 | |
| WO | 2006074553 | A1 | 7/2006 | |
| WO | WO 2006 074553 | A1 * | 7/2006 | |
| WO | WO 2006074553 | A1 * | 7/2006 | |
| WO | 2007041785 | A1 | 4/2007 | |

OTHER PUBLICATIONS

"Lubrication properties of trimethylolpropane esters based on palm oil and palm kernel oils", Eur. J. Lipid. Sci. Technol., 106 (2004) 52-60.
S. Sreenivasan, J. Am. Oil Chem. Cos., 1978, 55, 769-805.

* cited by examiner

*Primary Examiner* — Nicole M Buie-Hatcher
*Assistant Examiner* — M. Reza Asdjodi
(74) *Attorney, Agent, or Firm* — D'Ambrosio & Menon, PLLC; Usha Menon

(57) ABSTRACT

The invention relates to compositions including esters of polyvalent alcohols that are esterified with fatty acids, partially unsaturated, from plant oils, and to the use thereof as cooling and insulating fluids for transformers.

18 Claims, No Drawings

ESTERS AS COOLING AND INSULATING FLUIDS FOR TRANSFORMERS

PRIORITY CLAIM

This patent application is the U.S National stage under U.S.C. 371 of PCT/DE2013/000222 filed Apr. 26, 2013, and designating the United States and claims priority to German Patent Application No.: DE 10 2012 103 701.9 filed Apr. 26, 2012.

FIELD OF THE INVENTION

The present invention relates to compositions comprising esters of polyvalent alcohols that are esterified with fatty acids, partially unsaturated, made of plant oils, and to their use as cooling and insulating fluids for transformers.

BACKGROUND

A reliable operation of transformers requires sufficient electrical insulation as well as the dissipation of the heat released during the conversion of electrical voltages. It is known that certain fluids have insulating and heat-dissipating properties. Conventionally, mineral oils or silicones are used. However, they have very poor biodegradability and thus represent a hazard for humans and the environment in the case of leaks, defects in liquid tightness or another discharge from the transformer. Mineral oils in addition have a very low flash point below 150° C., i.e., a high fire hazard potential.

Therefore, readily biodegradable plant oils have been proposed for use as insulation fluid in transformers. It is obvious to use plant oils as insulation fluid, since they are readily and completely biodegradable and generally not hazardous for water (according to the German "Administrative Regulation on Substances Hazardous to Waters"—VwVwS) and they have flash and fire points above 300° C. (according to the method by Pensky-Martens), all this at advantageous raw material costs. In addition, these plant oils have a higher water absorption capacity than mineral oil, which reduces the degradation of the cellulose of the transformer board and increases the useful life of the transformer.

Plant oils have already been used as insulation oils approximately since the end of the 19th century. However, their use was soon discontinued, since they resinify relatively rapidly by oxidation when air enters the transformers in which they are used. As a result of the use of hermetically sealed transformers, which largely exclude the entry of air, the requirement profile has changed in recent years.

The oxidation sensitivity continues to be important, but not to the extent it was in the transformers of the past, and it is manageable in hermetically sealed transformers. On the other hand, awareness about the environment has increased considerably worldwide. Accordingly, plant oils such as castor bean oil, sunflower oil, rapeseed oil, soybean oil and other oils have been proposed a number of times as transformer fluid, see also WO 97/22977 A1 and U.S. Pat. No. 6,340,658 B1.

In addition to oxidation stability, other required properties of a transformer fluid have become increasingly important, including high flash and fire points, low viscosity (for improved heat convection), and in particular also a low pour point, low acid number, good dielectric stability and low sludge formation in the stability test according to DIN EN 61099 "Specifications for unused synthetic organic esters for electrical purposes" (see Table 1). In addition, good corrosion properties and seal compatibility are absolutely required. Unfortunately, natural plant oils do not satisfy all these necessary or desired properties simultaneously, and they have weaknesses in terms of one or more of the properties, in particular with regard to viscosity and cold properties as well as oxidation stability. The oxidation stability is generally increased to a minimum level by adding antioxidants. However, the cold properties in particular can only be improved marginally by means of additives. Lowering the viscosity by simply mixing plant oils with portions of other clearly thinner base oils is not possible because of required high flash and fire points.

GB 1602092 discloses the use of trimethylolpropane esters of linear saturated fatty acids with 7 to 10 C atoms and their use as dielectric insulation fluid for transformers. From the examples, trimethylolpropane esters having a viscosity of 25 or 30 $mm^2/s$ in each case at 30° C. and a fire point of 277° C. or 293° C. are known. WO 2005/118756 A1 has a similar disclosure content. However, it discloses more broadly linear or branched carboxylic acids with 6 to 12 C atoms. However, branched carboxylic acids are not natural fatty acids.

SUMMARY OF THE INVENTION

The present invention relates to esters in the form of mixed esters and/or ester mixtures

I

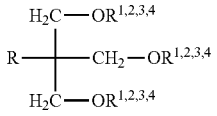

with R, $R^1$ and $R^2$ or R, $R^1$ to $R^4$ independently of one another and next to another:

R=methyl, ethyl, propyl, isopropyl or mixtures thereof, $R^1$=at least 30%, preferably at least 50%, linear saturated acid groups with 6 to 12 C atoms, preferably with 8 to 10 C atoms, and $R^2$=at least 30%, preferably at least 20%, acid groups with 14 to 22 C atoms, preferably 18 C atoms, comprising one or more double bonds, preferably with cis-configured double bond(s), optionally characterized furthermore as follows:

$R^3$ 0 to at most 20%, preferably 1 to at most 10%, linear saturated acid groups with 14 to 22 C atoms, $R^4$ 0 to at most 20%, preferably at most 10%, other acid groups apart from R', $R^2$ and optionally $R^3$.

The ester consists of the acid groups $R^1$ to $R^4$ and of the alcohol group

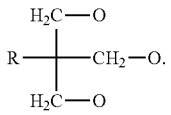

The above percentages relate to the relative number of the acid groups $R^1$, $R^2$, and so on, to the extent that they are bound to the polyvalent alcohol(s) of general formula

II

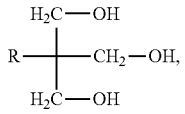

regardless of whether they are in the form of a mixture of esters (ester mixture) with in each case uniform structure, such as, for example

III

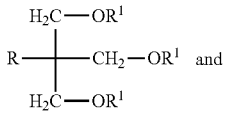

IV

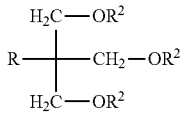

or in the form of mixed esters, in which the acid groups $R^1$ and $R^2$ or $R^1$ to $R^4$ of an alcohol residue are present in any distribution. The percentages add up to a total of 100.

The fatty acids in accordance with acid group $R^1$ or $R^2$ and $R^3$ can preferably be obtained from natural fats in the form of a mixture, for example, from natural sources such as sunflower oil or rapeseed oil, preferably from their variants with high oleic acid content.

The acid groups $R^2$ are made of fatty acids having a chain length of 6 to 12 C atoms, in particular 8 or 10 C atoms, which can be obtained, for example, as distillation cuts from plant oils such as, for example, coconut oil, palm kernel oil, and others.

DETAILED DESCRIPTION OF THE INVENTION

It was found surprisingly that the above-mentioned mixed esters or ester mixtures satisfy and even exceed the requirements of DIN EN 61099 (see Table 1), i.e., in particular that they have simultaneously a low viscosity, a low pour point (DIN ISO 3016), a high flash point according to Pensky-Martens—(DIN ES ISO 2719, >250° C.) and a high fire point (DIN EN ISO 2592—) as well as a high oxidation stability. In addition, they have a satisfactory biodegradability. Moreover, the dielectric insulation fluid according to the invention is produced, in particular largely, for example, more than 80% by weight thereof (relative to the starting material used for the synthesis), on the basis of renewable raw materials.

Surprisingly, it was discovered that esters of polyvalent alcohols

V

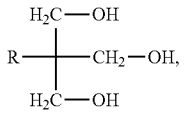

such as particularly trimethylolpropane (R=ethyl) esterified to one another and then mixed or esterified together with two or more different fatty acids excellently satisfy the above-described requirements.

Therefore, a first subject matter of the present invention relates to compositions comprising the above esters of polyvalent alcohols according to formula V with three hydroxy groups, such as trimethylolpropane esters with a) linear acid groups with 6 to 12 C atoms, and b) fatty acids comprising 14 to 22 C atoms, particularly predominantly 18 C atoms, and one or more double bonds, preferably cis-configured, or of the above definition, in transformers or as transformer oil.

The acid residue b) can be obtained from natural plant oils such as sunflower oil, rapeseed oil, and others, preferably from their variants with high oleic acid content. In particular, a high oleic acid content of proportion of b) guarantees good cold properties and simultaneously a high aging stability.

The fatty acid residues a) with a chain length of 6 to 12 C atoms, in particular 8 or 10 C atoms, can be obtained either from plant oils such as, for example, coconut oil (for example, as a distillation cut) or also entirely or partially from synthetic sources. The residues $R^2$ are linear and they preferably comprise 8 and/or 10 C atoms.

In a triester, all the residues R can be identical, or only two residues can be identical, or all the residues can be different. It is preferable to use a distribution of the residues $R^1$ and $R^2$ such that the flash point or the fire point is higher than, preferably as much as possible higher than 250° C., and the viscosity has a value of <= or <35 $mm^2/s$ at 40° C. and the pour point has a value <−45° C. The low viscosity and in particular the low pour point can be achieved by selected acid components in the ester.

For a mixed ester 1 of trimethylolpropane (TMP) with $R^2$=oleic residue with 18 C atoms (purity above 95 wt %) and with more than 80 wt % of $R^2$ with cis-configured double bond and with a residue $R^1$ with 8 and/or 10 C atoms, the following mixed esters 1 can be obtained

TABLE 1

Properties of different mixed esters 1

| | Ester 1: $[R^1]:[R^2]$ | | | |
|---|---|---|---|---|
| | 1:1 | 2:1 | 3:1 | DIN EN 6199 |
| Appearance | Clear | clear | clear | Clear |
| Color | 1.0 | 1.0 | 1.0 | |
| Density 20° C. [g/mL] | 0.929 | 0.930 | 0.933 | <1 |
| Refractive index [—] | 1.466 | 1.462 | 1.461 | ±0.01 |
| Viscosity −20° C. [$mm^2/s$]* | 993 | 860 | 767 | <3000 |
| Viscosity 40° C. [$mm^2/s$]** | 35.0 | 30.8 | 28.4 | <35 |
| Pour point [° C.] | −50 | −55 | −60 | <−45 |
| Flash point, PM [° C.] | >250 | >250 | >250 | >250 |

*calculated

**kinematic viscosity

TABLE 2

Physical properties of ester 2 (TMP plus oleic acid) and ester 3 (TMP plus n-C8/C10 acid) and properties of the ester mixtures of ester 2 and ester 3

| | | | Ester 2:Ester 3 | | | |
|---|---|---|---|---|---|---|
| | Ester 2 | Ester 3 | 1:1 | 1:2 | 1:3 | DIN EN 6199 |
| Appearance | clear | Clear | clear | clear | clear | Clear |
| Density [g/cm$^3$] 20° C. | 0.92 | 0.945 | 0.929 | 0.933 | 0.936 | |
| Viscosity −20° C. [mm$^2$/s]* | 1400 | 1000 | 993 | 860 | 767 | <3000 |
| Viscosity 40° C. [mm$^2$/s]** | 48 | 20 | 34.0 | 29.7 | 27.5 | <35 |
| Pour point [° C.] | <−60 | −51 | −58 | −58 | −60 | <−45 |
| Flash point PM [° C.] | >250 | 230 | >250 | 250 | 230 | >250 |
| Flash point CoC [° C.] | 300 | 250 | 288 | 276 | 278 | — |

*calculated

**kinematic viscosity

By means of the physical mixtures of the trimethylolpropane esters 2 and 3, all the intermediate viscosities can be adjusted, and the pour point is lowered. In particular, however, it was found surprisingly and unpredictably that with the physical mixture of ester 2 and 3 at the ratio of 1:1 to 1:2, the flash point exceeds the limit value of 250° C. required by DIN EN 61099.

It is important that, by using different ratios of [$R^1$]:[$R^2$] according to Table 1 or of ester 2:ester 3, the viscosity and pour point as well as the flash point can be adjusted. It is also important that the viscosity of the mixed esters or ester mixture according to the invention is clearly lower than that of the pure trimethylolpropane ester 2 (TMP plus $R^2$=oleic acid residue), and that the pour point is lower than that of the trimethylolpropane ester 3, which has already been proposed as insulation fluid. Thus, in terms of performance, the ester mixture or the mixture of esters according to the invention is superior to ester 3 (compare Table 1 and Table 2).

Thus, it must be retained that each one of the "pure type" esters 2 and 3 by itself does not satisfy the requirements in terms of all of the target parameters of viscosity, cold behavior and flash point, in contrast to the special intra- (Table 1) or intermolecular (Table 2) mixtures.

The mixed esters or mixtures of esters according to the invention thus have advantages in comparison to the prior art and represent progress in the direction toward the desired properties of a transformer oil.

The class of mixed trimethylolpropane triesters satisfies DIN EN 61099 and it was classified, in accordance with the Administrative Regulation on Substances Hazardous to Waters (VwVwS) of the Commission for the Evaluation of Substances Hazardous to Waters (KBwS) as not hazardous to water (NWG).

Their natural degradability, which is clearly more than 60% after 28 days, is thus in the range of "readily biodegradable" according to the final degradability test OECD 301. The compositions according to the invention have good thermal properties and excellent dielectric properties.

In order to further improve the properties of the insulation fluid, it is possible and preferable to use antioxidants and/or metal deactivators and/or pour point depressants.

In an additional embodiment, the composition according to the invention comprises in addition:

between 0.01 and 3% by weight %, in particular 0.1 and 2.5% by weight %, particularly preferably 1.0 and 2.0% by weight % of at least one antioxidant and/or 0.01 and 1.0% by weight, preferably 0.02 and 0.08% by weight, of at least one metal deactivator and/or 0.1 to 5% by weight, in particular 0.1 and 3% by weight and particularly preferably 1.5 to 2.5% by weight, of at least one pour point depressant and/or 0.01 to 2% by weight in particular 0.01 and 0.5% by weight, and particularly preferably 0.01% by weight to 0.08% by weight of at least one defoamer in each case relative to the weight of the ester.

The antioxidants here are selected preferably from the following substances and mixtures of the listed substances:

from the group of the phenolic antioxidants such as, for example, alkylated monophenols (for example, 2,6-di-tert-butyl-4-methylphenol, 2,6-di-tert-butyl-phenol, 2-tert-butyl-4,6-dimethylphenol and/or 2,6-di-tert-butyl-4-ethylphenol) and/or alkylated hydroquinones (for example, 2,5-di-tert-butyl-hydroquinone and/or 2,6-di-tert-butyl-4-methoxyphenol) and/or hydroxylated thiodiphenyl ethers (for example, 2,2'-thio-bis-(4-octylphenol)) and/or alkylidene bisphenols (for example, 2,2'-methylene-bis-(6-tert-butyl-4-methylphenol)) and/or benzyl compounds (for example, 1,3,5-tri-(3,5-di-tert-butyl-4-hydroxybenzyl)-2,4,6-tri-methylbenzene) and/or acylaminophenols (for example, N-(3,5-di-tert-butyl-4-hydroxyphenol)-carbamic acid octyl ester)® and from the group of the aminic antioxidants: di-phenylamine, octylized di-phenylamine and/or N-phenyl-1-naphthylamine® tocopherols and gallates.

The metal deactivators are preferably selected from the following substances and mixtures of the listed substances: benzotriazoles and their derivatives, salicylaminoguanidine, toluenetriazoles and their derivatives, 2-mercaptobenzothiazole, 2-mercaptobenzotriaozole and/or salicylidene-propylenediamine and their derivatives.

The pour point depressants are preferably organic compounds such as diethyl hexyl adipates, methacrylate polymers, polyvinyl acetates and their derivatives and/or mixtures of the listed substances.

The antifoaming additives are preferably compounds such as polyethylene glycol ethers, amino alcohols and/or additives based on esters.

According to another embodiment, compositions according to the various embodiments described herein, comprising the esters of general formula I according to the above definition(s) can be used as dielectric insulation fluid in electrical power engineering units such as transformers.

The transformers are power transformers, distribution transformers, pole transformers, on-load tap changers or changeover switches.

The embodiments are explained in the following test examples without being limited to them.

TEST EXAMPLES

Test Example 1

Mixed Esters, Acid Catalyzed Esterification of Trimethylolpropane with the Fatty Acid Mixture 1.03 mol fatty acid mixture (0.26 mol oleic acid, 0.46 mol caprylic acid and 0.31 mol capric acid), 5 g p-toluenesulfonic acid and 0.33 mol (40.7 g) trimethylolpropane were boiled with 150 mL o-xylene in the Dean-Stark apparatus at reflux (3 h, 145° C.) until water stopped being removed. Subsequently, the preparation was washed in the separation funnel with deionized water until the aqueous phase was neutral. The o-xylene was separated using a rotary evaporator. Residues of the solvents and of the fatty acids were removed by short-path distillation at 168° C. and $2\times10^{-2}$ mbar. The yield was 80%.

Test Example 2

Mixed Esters, Alkaline Transesterification of TMP Trioleyl Esters and C8/C10 TMP Triesters 300 g dried mixture of trimethylolpropane trioleyl esters and C8/C10 trimethylolpropane triesters at a ratio of 1:2 were repeatedly frozen and thawed under oxygen-free nitrogen and after heating to 60° C., 2 g sodium methoxide were added. After a reaction time of 2 hours, the preparation was taken up in 500 mL tert-butyl methyl ether.

After the addition of diluted HCl for the neutralization of the sodium methoxide, the preparation was washed with deionized water until the aqueous phase was neutral.

The tert-butyl methyl ester was separated by means of the rotary evaporator. Residues of the solvent and free acids were removed by short-path distillation at 168 ° C. and 2* 10-2 mbar. The yield was 87%.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of the structures and the combination of the individual elements may be resorted to without departing from the spirit and scope of the invention.

The invention claimed is:

1. An electrical power engineering unit provided with a dielectric insulation fluid, wherein the insulation fluid is a composition comprising esters of general formula I,

I

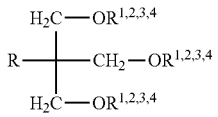

where

R=methyl, ethyl, propyl, isopropyl or mixtures thereof, and $R^1$=at least 30% linear saturated acid groups with 8 or 10 or 8 and 10 C atoms, $R^2$=at least 20% acid groups with 14 to 22 C atoms comprising one or more double bonds, wherein more than 90% of the residues $R^2$ comprise 18 C atoms and a double bond and optionally $R^3$=0 to at most 20% linear saturated acid groups with 14 to 22 C atoms, and optionally $R^4$=0 to at most 20% other acid groups apart from $R^1$, $R^2$ and optionally $R^3$, wherein the residues $R^1$ and $R^2$ are at a numerical ratio of $R^1$ to $R^2$ from 1:1 to 5:1, and wherein the esters are mixed esters, in which the acid groups $R^1$ and $R^2$ and optionally $R^3$ and optionally $R^4$ of an alcohol residue are present in random distribution, and the mixed esters are obtainable from alcohols

V

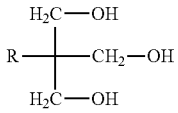

by a combined reaction with two or more different acids of the above-mentioned acid groups.

2. The unit according to claim 1, wherein the composition at the same time has a viscosity of <35 $mm^2/s$ at 40° C., a pour point of less than −50° C. and a flash point of more than 250° C.

3. The unit according claim 1, wherein more than 95% of the residues $R^2$ comprise 18 C atoms and a double bond.

4. The unit according to claim 1, wherein more than 80% of the residues $R^2$ comprise at least one cis-configured double bond.

5. The unit according to claim 2, wherein the composition has a fire point of more than 250° C.

6. The unit according to claim 1, wherein the composition additionally comprises one or more members of the following group:

between 0.01 and 3% by weight of at least one antioxidant, between 0.01 and 1.0% by weight of at least one metal deactivator, 0.1 to 5% by weight of at least one pour point depressant, 0.01 to 2% by weight of at least one defoamer, in each case relative to the ester(s).

7. The unit according to claim 6, wherein the antioxidant/the antioxidants are selected from one or more members of the group comprising phenolic antioxidants, aminic antioxidants, tocopherols and gallates.

8. The unit according to claim 6, wherein the metal deactivator(s) are selected from one or more members of the group comprising benzotriazoles and their derivatives, salicylaminoguanidine, toluene triazoles and their derivatives, 2-mercaptobenzothiazole, 2-mercaptobenzothiazole and salicylidene-propylenediamine and their derivatives.

9. The unit according to claim 6, wherein the pour point depressant(s) are selected from one or more members of the group comprising diethyl hexyl adipates, methacrylate polymers, polyvinylacetates and their respective derivatives.

10. The unit according to claim 6, wherein the defoamer(s) are selected from one or more members of the group comprising polyalkylene glycol ethers, amino alcohols and additives based on esters.

11. The unit according to claim 1, wherein more than 70% by weight, preferably more than 85% by weight, in particular more than 95% by weight, and particularly preferably more than 98% by weight of the composition consists exclusively of esters according to claim 1.

12. The unit according to claim 1, wherein $R^2$=stands for at least 30% acid groups with 14 to 22 C atoms comprising one or more double bonds and wherein more than 90% of the residues $R^2$ comprise 18 C atoms and a double bond.

13. The unit according to claim 1, wherein the residues $R^1$ and $R^2$ are in a numerical ratio of $R^1$ to $R^2$ from 1:1 to 2:1.

14. The unit according to claim 1, wherein

R=ethyl, $R^1$=at least 50% linear saturated acid groups with 8 or 10 or 8 and 10 C atoms, $R^2$=at least 20% acid groups with 14 to 22 C atoms comprising one or more double bonds, wherein more than 90% of the residues $R^2$ comprise 18 C atoms and a double bond, and $R^3$=1 to at most 10%, linear saturated acid groups with 14 to 22 C atoms, and optionally $R^4$=0 to at most 10%, other acid groups apart from $R^1$, $R^2$ and optionally $R^3$.

15. The unit according to claim 1, wherein the unit is selected from the group consisting of power transformer, distribution transformer, pole transformer, current transformer, voltage transformer, on-load tap changer and changeover switch.

16. A method of using a composition as a dielectric insulation fluid in electrical power engineering units, wherein the composition comprises of esters of general formula I,

I

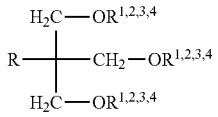

and wherein,

R=equals methyl, ethyl, propyl, isopropyl or mixtures thereof, and $R^1$=at least 30% linear saturated acid groups with 8 or 10 or 8 and 10 C atoms, and $R^2$=at least 20% acid groups with 14 to 22 C atoms comprising one or more double bonds, wherein more than 90% of the residues $R^2$ comprise 18 C atoms and a double bond and optionally $R^3$=0 to at most 20% linear saturated acid groups with 14 to 22 C atoms, and optionally $R^4$=0 to at most 20% other acid groups apart from $R^1$, $R^2$ and optionally $R^3$, wherein the residues $R^1$ and $R^2$ are in a numerical ratio of $R^1$ to $R^2$ from 1:1 to 5:1 and, wherein the esters are mixed esters in which the acid groups $R^1$ and $R^2$ and optionally $R^3$ and optionally $R^4$ of an alcohol residue are present in random distribution, and the mixed esters are obtainable from alcohols

V

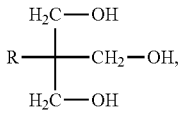

by a combined reaction with two or more different acids of the above-mentioned acid groups.

17. The method according to claim 16, wherein $R^2$=stands for at least 30% acid groups with 14 to 22 C atoms comprising one or more double bonds and wherein more than 90% of the residues $R^2$ comprise 18 C atoms and a double bond.

18. The method according to claim 16, wherein the units are power transformers, distribution transformers, pole transformers, current transformers and voltage transformers as well as on-load tap changers or changeover switches.

* * * * *